US010667363B1

(12) United States Patent
Chen et al.

(10) Patent No.: US 10,667,363 B1
(45) Date of Patent: May 26, 2020

(54) SYSTEM AND METHOD OF DRIVING LED STRING

(71) Applicant: ANPEC ELECTRONICS CORPORATION, Hsinchu (TW)

(72) Inventors: Wen-Yen Chen, Hsinchu (TW); Ming-Hung Chang, Hsinchu (TW)

(73) Assignee: ANPEC ELECTRONICS CORPORATION, Hsinchu County (TW)

( * ) Notice: Subject to any disclaimer, the term of this patent is extended or adjusted under 35 U.S.C. 154(b) by 0 days.

(21) Appl. No.: 16/564,380

(22) Filed: Sep. 9, 2019

(30) Foreign Application Priority Data

Jun. 5, 2019 (TW) ..... 108119466 A

(51) Int. Cl.
*H05B 45/46* (2020.01)
*H05B 45/10* (2020.01)
*G09G 3/34* (2006.01)

(52) U.S. Cl.
CPC ..... *H05B 45/46* (2020.01); *G09G 3/3406* (2013.01); *H05B 45/10* (2020.01); *G09G 2330/021* (2013.01); *G09G 2330/12* (2013.01)

(58) Field of Classification Search
CPC .... H05B 45/46; H05B 45/10; H05B 33/0812; H05B 33/0815; H05B 33/0818; H05B 33/083; H05B 33/0866; H05B 33/0884; H05B 33/0887; H05B 33/089; G09G 3/3406; G09G 2330/021; G09G 2330/12; G01R 31/026; G01R 31/2621; H02M 1/08; H02M 2001/0003; H03K 17/0822; H05K 13/00; Y02B 20/341; Y10T 29/49117; Y10T 29/49169
See application file for complete search history.

(56) References Cited

U.S. PATENT DOCUMENTS

| | | | | |
|---|---|---|---|---|
| 9,066,406 | B1 * | 6/2015 | Xiong | H02M 3/156 |
| 2012/0236456 | A1 * | 9/2012 | Yu | H03K 17/0822 361/91.1 |
| 2014/0085762 | A1 * | 3/2014 | Shimano | H02M 1/08 361/91.6 |
| 2016/0029448 | A1 * | 1/2016 | Huang | H05B 33/0812 315/128 |
| 2016/0081148 | A1 * | 3/2016 | Liang | H05B 33/089 324/414 |
| 2016/0291682 | A1 * | 10/2016 | Herfurth | H05B 33/0815 |
| 2018/0092176 | A1 * | 3/2018 | Tanaka | H05B 33/0815 |

* cited by examiner

*Primary Examiner* — Renan Luque
(74) *Attorney, Agent, or Firm* — Li & Cai Intellectual Property (USA) Office

(57) ABSTRACT

A method of driving an LED string is provided and includes steps of: (a) determining whether or not a detected voltage of a control terminal of a transistor is lower than a first reference voltage by a first comparator, if not, raising a voltage of the LED string by a power supply device and performing step (a), if yes, performing step (b); (b) determining whether or not the detected voltage is lower than a second reference voltage by a second comparator, if not, determining that a short circuit occurs, if yes, performing step (c); (c) increasing an output current of the LED string by an input current source; and (d) determining whether or not a current of the LED string reaches a maximum current that is adjustable by a light controller, if yes, determining that a short circuit occurs, if not, returning to step (c).

18 Claims, 5 Drawing Sheets

SYSTEM AND METHOD OF DRIVING LED STRING

CROSS-REFERENCE TO RELATED PATENT APPLICATION

This application claims the benefit of priority to Taiwan Patent Application No. 108119466, filed on Jun. 5, 2019. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a system of driving an LED string, and more particularly to a system and a method of driving an LED string of a display device.

BACKGROUND OF THE DISCLOSURE

Liquid crystal display devices have been widely used. For example, a liquid crystal display module can be applied to a screen of an electronic product, such as a television, a tablet, a notebook computer, a desktop, a mobile phone and so on. Each display module includes a backlight panel. Generally, a number of LED strings are uniformly placed in the backlight panel and each LED string includes light-emitting diodes (LEDs) having high brightness. In addition, each display module includes an LED short-circuit detector circuit for detecting a short circuit or other abnormal states occurring in each LED string. However, the LED short-circuit protector circuit has complex structure and requires high costs, and cannot timely protect the LED string.

SUMMARY OF THE DISCLOSURE

In response to the above-referenced technical inadequacies, the present disclosure provides a method of driving a light-emitting diode (LED) string. The method is applicable to detect an operational parameter of one or more LED strings of a display device and drive the one or more LED strings according to the operational parameter. Each LED string is connected to a transistor. The transistor has a first terminal, a second terminal and a control terminal. The first terminal of the transistor is connected to a negative terminal of the LED string. The second terminal of the transistor is connected to a reference potential. The control terminal of the transistor is connected to a system of driving the LED string. The method includes the following steps: (a) obtaining a detected voltage of the control terminal of the transistor by a first comparator; (b) determining, by a first comparator, whether or not the detected voltage of the control terminal of the transistor is lower than a first reference voltage provided by a first reference voltage source, in response to determining the detected voltage not being lower than the first reference voltage, controlling a power supply device to raise a voltage of the LED string by a light controller and then performing step (a), in response to determining the detected voltage being lower than the first reference voltage, obtaining the detected voltage of the control terminal of the transistor by a second comparator; (c) determining, by the second comparator, whether or not the detected voltage of the control terminal of the transistor is lower than a second reference voltage provided by a second reference voltage source, in response to determining that the detected voltage is not lower than the second reference voltage, determining that a short circuit does not occur in the LED string, in response to determining that the detected voltage is lower than the second reference voltage, controlling an input current source by the light controller to provide an input current to the LED string such that an output current of the LED string increases; and (d) determining, by the light controller, whether or not a current flowing through the LED string reaches a maximum current that is adjustable by the light controller, in response to determining that the current reaches the maximum current, determining that a short circuit occurs in the LED string, in response to determining that the current does not reach the maximum current, returning to obtain the detected voltage of the control terminal of the transistor by the second comparator.

In addition, the disclosure provides a method of driving a light-emitting diode (LED) string. The method is applicable to detect an operational parameter of one or more LED strings of a display device and drive the one or more LED strings according to the operational parameter. Each LED string is connected to a transistor. The transistor has a first terminal, a second terminal and a control terminal. The first terminal of the transistor is connected to a negative terminal of the LED string. The second terminal of the transistor is connected to a reference potential. The control terminal of the transistor is connected to a system of driving the LED string. The method includes the following steps: (a) obtaining a first detected voltage of the second terminal of the transistor by a first comparator; (b) determining, by a first comparator, whether or not the first detected voltage of the second terminal of the transistor is higher than or equal to a first reference voltage, in response to determining that the first detected voltage is not higher than or equal to the first reference voltage, controlling a power supply device to raise a voltage of the LED string by a light controller and then performing step (a), in response to determining that the first detected voltage is higher than or equal to the first reference voltage, obtaining a second detected voltage of the control terminal of the transistor by a second comparator; (c) determining, by the second comparator, whether or not the second detected voltage of the control terminal of the transistor is lower than a second reference voltage, in response to determining that the second detected voltage is not lower than the second reference voltage, determining that a short circuit does not occur in the LED string, in response to determining that the second detected voltage is lower than the second reference voltage, controlling an input current source by the light controller to provide an input current to the LED string such that an output current of the LED string increases; and (d) determining whether or not a current flowing through the LED string reaches a maximum current that is adjustable by the light controller, in response to determining that the current reaches the maximum current, determining a short circuit to occur in the LED string, in response to determining that the current does not reach the maximum current, returning to obtain the second detected voltage of the control terminal of the transistor by the second comparator.

In addition, the disclosure provides a system of driving a light-emitting diode (LED) string. The system is applicable to detect an operational parameter of one or more LED strings of a display device and drive the one or more LED strings according to the operational parameter. Each LED string is connected to a transistor. The transistor has a first terminal, a second terminal and a control terminal. The first terminal of the transistor is connected to a negative terminal of the LED string. The second terminal of the transistor is connected to a reference potential. The control terminal of the transistor is connected to the system of driving the LED string. The system of driving the LED string includes one or more first comparators, one or more second comparators and a light controller. Each first comparator has a first comparison input terminal and a second comparison input terminal, which are respectively connected to a first reference voltage source and the control terminal of the transistor. The first comparator is configured to compare a detected voltage of the control terminal of the transistor with a first reference voltage provided by a first reference voltage source to output a first comparing signal. Each second comparator has a third comparison input terminal and a fourth comparison input terminal, which are respectively connected to a second reference voltage source and the control terminal of the transistor. The second comparator is configured to compare the detected voltage of the control terminal of the transistor with a second reference voltage provided by the second reference voltage source to output a second comparing signal. The second reference voltage is not equal to the first reference voltage. The light controller is connected to output terminals of the one or more first comparators and output terminals of the one or more second comparators. When the light controller determines that the detected voltage of the control terminal of the transistor is not lower than the first reference voltage according to the first comparing signal from the first comparator, the light controller controls a power supply device to raise a voltage of the LED string. When the light controller determines that the detected voltage of the control terminal of the transistor is not lower than the second reference voltage according to the second comparing signal from the second comparator, the light controller determines that a short circuit does not occur in the LED string. When the light controller determines that the detected voltage of the control terminal of the transistor is lower than the second reference voltage according to the second comparing signal from the second comparator, the light controller controls an input current source to provide an input current to the LED string such that an output current of the LED string increases. When the light controller determines that a current flowing through the LED string reaches a maximum current that is adjustable by the light controller, the light controller determines that a short circuit occurs in the LED string.

In addition, the disclosure provides a system of driving a light-emitting diode (LED) string. The system is applicable to detect an operational parameter of one or more LED strings of a display device and drive the one or more LED strings according to the operational parameter. Each LED string is connected to a transistor. The transistor has a first terminal, a second terminal and a control terminal. The first terminal of the transistor is connected to a negative terminal of the LED string. The second terminal of the transistor is connected to a reference potential. The control terminal of the transistor is connected to the system of driving the LED string. The system of driving the LED string includes one or more first comparators, one or more second comparators and a light controller. Each first comparator has a first comparison input terminal and a second comparison input terminal, which are respectively connected to a first reference voltage source and the second terminal of the transistor. The first comparator is configured to compare a first detected voltage of the second terminal of the transistor with a first reference voltage provided by a first reference voltage source to output a first comparing signal. Each second comparator has a third comparison input terminal and a fourth comparison input terminal, which are respectively connected to a second reference voltage source and the control terminal of the transistor. The second comparator is configured to compare a second detected voltage of the control terminal of the transistor with a second reference voltage provided by the second reference voltage source to output a second comparing signal. The light controller is connected to output terminals of the one or more first comparators and output terminals of the one or more second comparators. When the light controller determines that the first detected voltage of the second terminal of the transistor is lower than the first reference voltage according to the first comparing signal from the first comparator, the light controller controls a power supply device to raise a voltage of the LED string. When the light controller determines that the second detected voltage of the control terminal of the transistor is not lower than the second reference voltage according to the second comparing signal from the second comparator, the light controller determines that a short circuit does not occur in the LED string. When the light controller determines that the second detected voltage of the control terminal of the transistor is lower than the second reference voltage according to the second comparing signal, the light controller controls an input current source to provide an input current to the LED string such that an output current of the LED string increases. When the light controller determines that a current flowing through the LED string reaches a maximum current that is adjustable by the light controller LIGC, the light controller determines that a short circuit occurs in the LED string.

As described above, more external pins are required in the conventional LED string driving system for connecting to the LED string, such that the conventional LED string driving system can detect and drive the LED string. In contrast, the present disclosure provides the system of driving the LED string and the method thereof. Only one or two pins are required for connecting the system of driving the LED string of the present disclosure to the control terminal such as the gate or base terminal of the transistor and/or the second terminal such as the drain or collector terminal of the transistor. The voltages of the control terminal and/or the second terminal of the transistor are detected and controlled. The detected voltages are compared with two or more different reference voltages and accordingly the power supplied to each LED string is adjusted. A short circuit or other abnormal conditions occurring in the LED string can be determined while costs can be saved.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
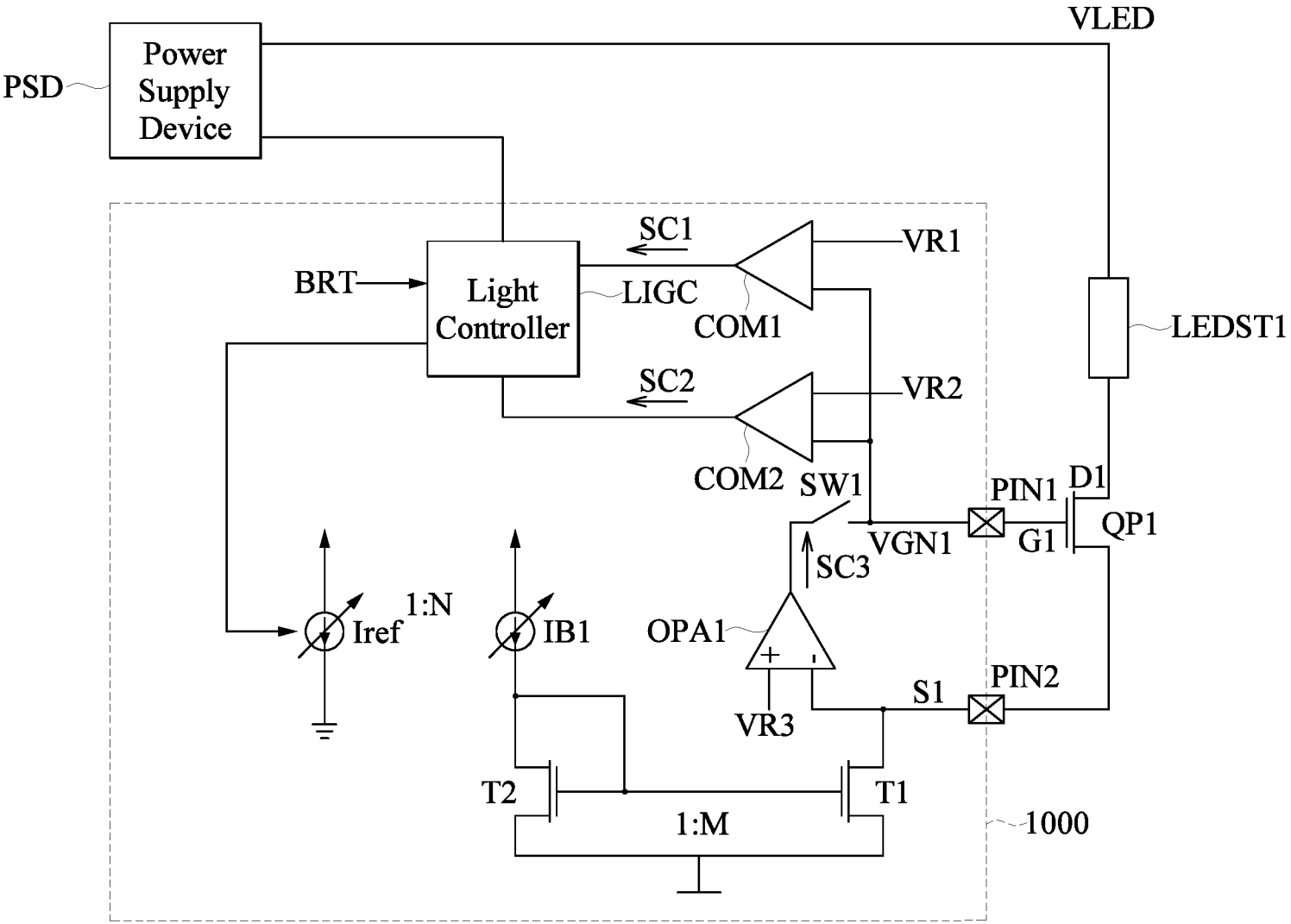
FIG. 1 is a circuit layout diagram of a system of driving a light-emitting diode string according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

With reference is made to FIG. 1, which is a circuit layout diagram of a system of driving a light-emitting diode string according to a first embodiment of the present disclosure. As shown in FIG. 1, a system 1000 of driving the light-emitting diode (LED) string of the first embodiment of the present disclosure is applicable to detect an operational parameter of a LED string LEDST1 of a display device and drive the LED string LEDST1 according to the operational parameter. The system 1000 of driving the LED string includes a first comparator COM1, a second comparator COM2, a first operational amplifier OPA1, a first switch SW1 and a light controller LIGC.

The LED string LEDST1 of the display device may include one or more LEDs. The light emitting diodes of the LED string LEDST1 may be connected in series with each other. A positive terminal of the LED string LEDST1 is connected to a power supply device PSD, and a negative terminal of the LED string LEDST1 is connected to the system 1000 of driving the LED string through a transistor QP1.

The transistor QP1 has a first terminal, a second terminal and a control terminal. In the embodiment, the transistor QP1 is an N-channel enhancement mode MOSFET, which has a drain terminal D1 as the first terminal, a source terminal S1 as the second terminal and a gate terminal G1 as the control terminal, but the present disclosure is not limited thereto. It should be understood that the transistor QP1 shown in FIG. 1 may be replaced with other types of transistors. For example, the transistor QP1 may be an NPN-type or PNP-type bipolar junction transistor, which has a collector terminal as the first terminal, an emitter terminal as the second terminal and a base terminal as the control terminal.

As shown in FIG. 1, in the embodiment, the first terminal such as the drain terminal D1 of the transistor QP1 is connected to the negative terminal of the LED string LEDST1. The system 1000 of driving the LED string has an external pin PIN1 connected to the control terminal such as the gate terminal G1 of the transistor QP1, and an external pin PIN2 connected to the second terminal such as the source terminal S1 of the transistor QP1. The conventional LED string driving system is connected to a drain terminal, a source terminal and a control terminal of a transistor respectively through three external pins, wherein the drain terminal of the transistor is directly connected to a negative terminal of a LED string and a voltage of the LED string is detected. In contrast, the system 1000 of driving the LED string of the embodiment has less external pins, and a voltage of the gate terminal G1 of the transistor QP1 is detected.

More specifically, the first comparator COM1 of the system 1000 of driving the LED string has a first comparison input terminal and a second comparison input terminal, which are respectively connected to a first reference voltage source and the control terminal such as the gate terminal G1 of the transistor QP1. The first comparator COM1 is configured to compare a detected voltage of the gate terminal G1 of the transistor QP1 with a first reference voltage VR1 provided by the first reference voltage source to output a first comparing signal SC1.

The second comparator COM2 has a third comparison input terminal and a fourth comparison input terminal, which are respectively connected to a second reference voltage source and the control terminal such as the gate terminal G1 of the transistor QP1. The second comparator COM2 is configured to compare the detected voltage of the gate terminal G1 of the transistor QP1 with a second reference voltage VR2 provided by the second reference voltage source to output a second comparing signal SC2. The second reference voltage VR2 received by the second comparator COM2 is not equal to the first reference voltage VR1 received by the first comparator COM1. In the embodiment, the first reference voltage VR1 is higher than the second reference voltage VR2.

The light controller LIGC is connected to the first comparator COM1, the second comparator COM2 and the power supply device PSD. The positive terminal of the LED string LEDST1 is connected to the power supply device PSD. The light controller LIGC may receive brightness information BRT or other operational parameter of the LED string LEDST1 of the display device from an external microcontroller (MCU) or a host, and accordingly output a duty cycle control signal for controlling the first switch SW1 to control a duty cycle of an output current of the LED string LEDST1.

In addition, the light controller LIGC generates a digital programming signal for setting/adjusting multiple values N and M according to the brightness information BRT. The light controller LIGC controls a reference current source Iref based on a preset ratio 1:N of the reference current source Iref and an input current source IB1 to correspondingly adjust an input current provided to the transistor QP1 from the input current source IB1 to control a peak current outputted by the LED string LEDST1. In addition, the light controller LIGC may receive the first comparing signal SC1 from the first comparator COM1 and the second comparing signal SC2 from the second comparator COM2.

The light controller LIGC is configured to control the power supply device PSD to provide appropriate input power to the LED string LEDST1 to adjust an output voltage VLED of the LED string LEDST1 to drive the LED string LEDST1 to emit desired light, according to the first comparing signal SC1, the second comparing signal SC2 and the brightness information BRT of the LED string LEDST1.

The first switch SW1 is connected between an output terminal of the first operational amplifier OPA1 and the gate terminal G1 of the transistor QP1. The first operational amplifier OPA1 has a first amplification input terminal and a second amplification input terminal, which are respectively connected to a third reference voltage source and the second terminal such as the source terminal S1 of the transistor QP1. The output terminal of the first operational amplifier OPA1 is connected to the gate terminal G1 of the transistor QP1.

The first operational amplifier OPA1 is configured to output an operation amplified signal SC3 according to a gain value multiplied by a difference between a voltage of the source terminal S1 of the transistor QP1 and a third reference voltage VR3 provided by the third reference voltage source. When the light controller LIGC turns on the first switch SW1 according to the brightness information BRT of the LED string LEDST1, the first switch SW1 allows the operation amplified signal SC3 to be outputted to the gate terminal G1 of the transistor QP1 from the first operational amplifier OPA1 to control the transistor QP1.

In addition, the system 1000 of driving the LED string may further include the reference current source Iref, the input current source IB1 and a current mirror. The current mirror includes a transistor T1 and a transistor T2. The reference current source Iref and the input current source IB1 are connected to the source terminal S1 of the transistor QP1 through the current mirror. When the reference current source Iref is adjusted according to the operational parameters such as the brightness information BRT of the LED string LEDST1 of the display device, the input current provided to the transistor QP1 through the transistors T1 and T2 of the current mirror from the input current source IB1 is correspondingly adjusted based on the preset ratio 1:N of the reference current source Iref and the input current source IB1.

Figure 2:
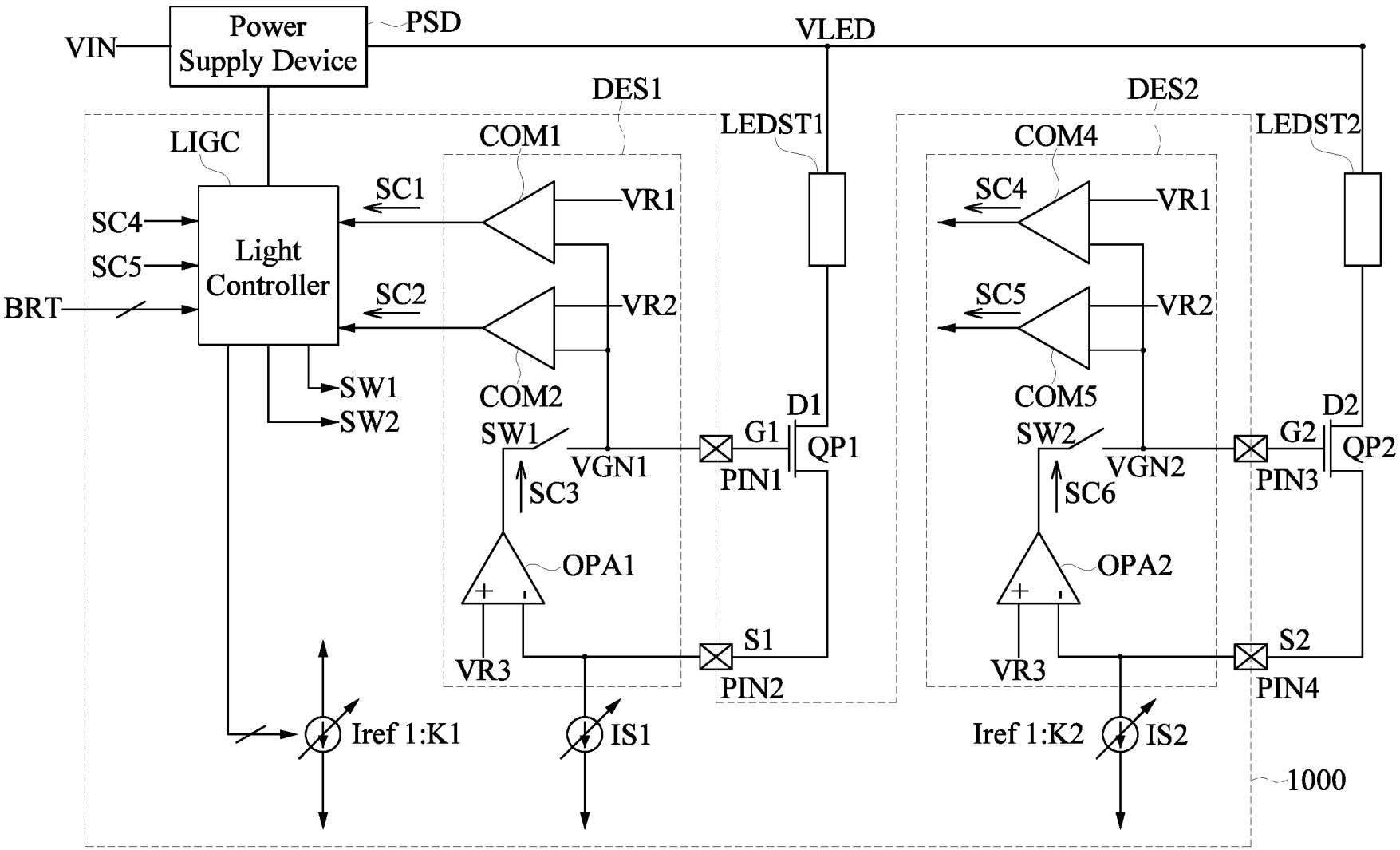
FIG. 2 is a circuit layout diagram of a system of driving a light-emitting diode string according to a second embodiment of the present disclosure.

With reference is made to FIG. 2, which is a circuit layout diagram of a system of driving a light-emitting diode string according to a second embodiment of the present disclosure. As shown in FIG. 2, the system 1000 of driving the LED string of the second embodiment is applicable to detect the operational parameters of the LED strings LEDST1 and LEDST2 of the display device and drive LED strings LEDST1 and LEDST2 according to the operational parameters.

The system 1000 of driving the LED string may include the light controller LIGC and N detector circuits, wherein N is any positive integer. The number of detector circuits depends on the number of LED strings. In the first embodiment, the system 1000 of driving the LED string drives only one LED string LEDST1 and includes only one detector circuit. However, in the second embodiment, the system 1000 of driving the LED string includes detector circuits DES1 and DES2, which are respectively used for detecting the LED strings LEDST1 and LEDST2.

The detector circuit DES1 includes the first comparator COM1, the second comparator COM2, the first operational amplifier OPA1 and the first switch SW1. The detector circuit DES2 includes a first comparator COM4, a second comparator COM5, a second operational amplifier OPA2 and a second switch SW2. The detector circuit DES1 and the detector circuit DES2 are connected to the light controller LIGC.

The second comparison input terminal of the first comparator COM1 and the fourth comparison input terminal of the second comparator COM2 of the detector circuit DES1 are connected to the control terminal such as gate terminal G1 of the transistor QP1 through the external pin PIN1 of the system 1000 of driving the LED string. In addition, the second amplification input terminal such as an inverting input terminal of the first operational amplifier OPA1 is connected to the first terminal such as the source terminal S1 of the transistor QP1 through the external pin PIN2 of the system 1000 of driving the LED string. The control terminal such as the gate terminal G1 of the transistor QP1 is connected to the output terminal of the first operational amplifier OPA1. As a result, a first negative feedback loop is formed. The operation of the detector circuit DES1 in the second embodiment is substantially the same as that in the first embodiment, and the same description will not be described again.

A second comparison input terminal of the first comparator COM4 and a fourth comparison input terminal of the second comparator COM5 of the detector circuit DES2 are connected to a control terminal such as a gate terminal G2 of a transistor QP2 through an external pin PIN3 of the system 1000 of driving the LED string. In addition, a fourth amplification input terminal such as an inverting input terminal of the second operational amplifier OPA2 is connected to a second terminal such as a source terminal S2 of the transistor QP2 through an external pin PIN4 of the system 1000 of driving the LED string. A control terminal such as a gate terminal G2 of the transistor QP2 is connected to an output terminal of the second operational amplifier OPA2. As a result, a second negative feedback loop is formed. A first terminal such as a drain terminal D2 of the transistor QP2 is connected to a negative terminal of the LED string LEDST2. A positive terminal of the LED string LEDST2 is connected to the power supply device PSD.

A first comparison input terminal and the second comparison input terminal of the first comparator COM4 are respectively connected to the first reference voltage source and the gate terminal G2 of the transistor QP2. An output terminal of the first comparator COM4 is connected to the light controller LIGC. The first comparator COM4 is configured to compare a detected voltage of the gate terminal G2 of the transistor QP2 with the first reference voltage VR1 provided by the first reference voltage source to output a first comparing signal SC4 to the light controller LIGC.

The second comparator COM5 has a third comparison input terminal and a fourth comparison input terminal, which are respectively connected to the second reference voltage source and the gate terminal G2 of the transistor QP2. An output terminal of the second comparator COM5 is connected to the light controller LIGC. The second comparator COM5 is configured to compare a detected voltage of the gate terminal G2 of the transistor QP2 with the second reference voltage VR2 provided by the second reference voltage source to output a second comparing signal SC5 to the light controller LIGC.

The light controller LIGC is connected to the first comparator COM4 and the second comparator COM5. The light controller LIGC is configured to control the power supply device PSD to provide an input power to the LED string LEDST2 to adjust an output voltage VLED of the LED string LEDST2 to drive the LED string LEDST2 to emit desired light, according to the first comparing signal SC4 from the first comparator COM4 and the second comparing signal SC5 from the second comparator COM5.

Figure 3:
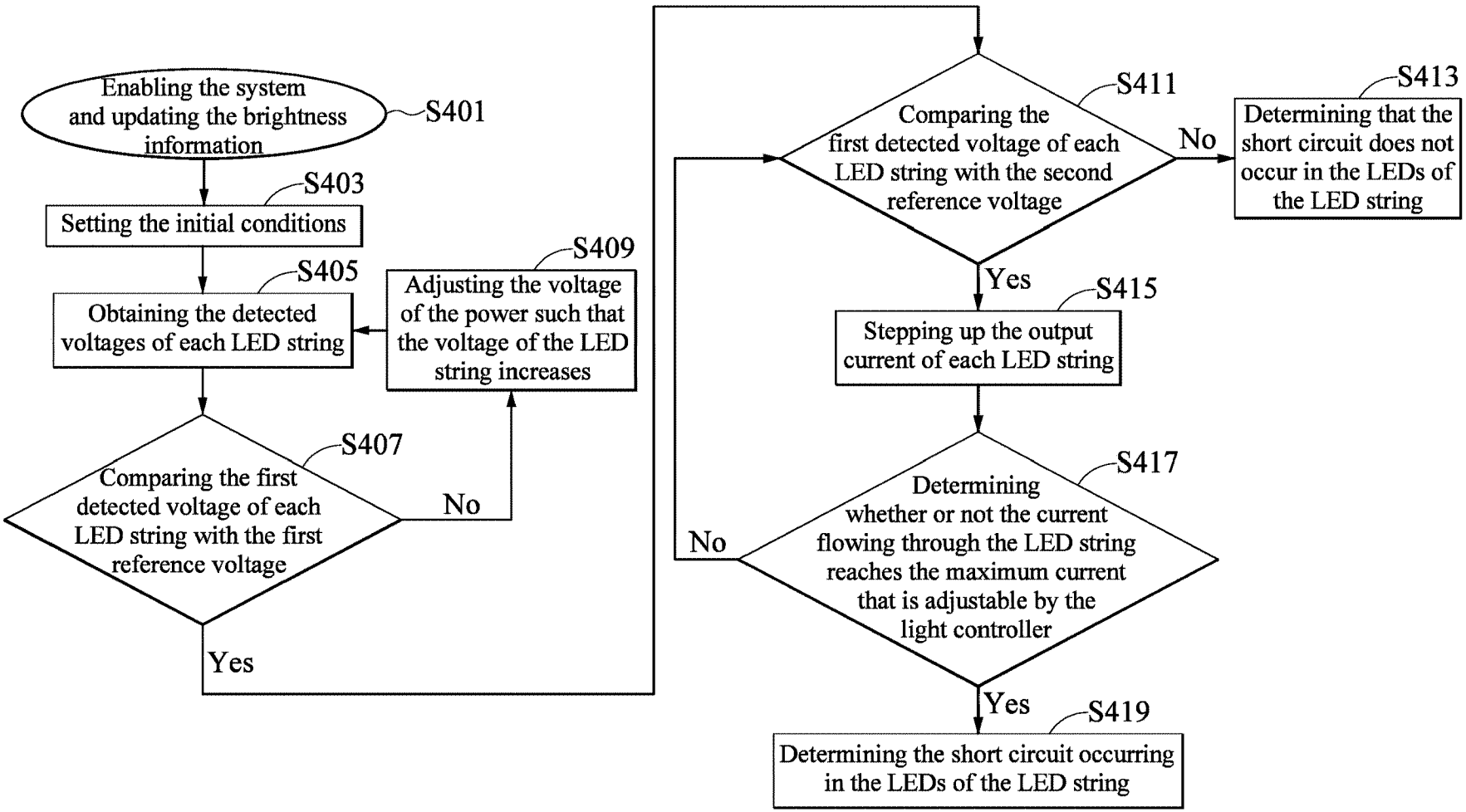
FIG. 3 is a flowchart diagram of a method of driving the light-emitting diode string according to the second embodiment of the present disclosure.

With reference is further made to FIG. 3, which is a flowchart diagram of a method of driving the light-emitting diode string according to the second embodiment of the present disclosure. As shown in FIG. 3, in the second embodiment, the method of driving the light-emitting diode string includes the following steps S401 to S419 and use the system 1000 of driving the LED string as shown in FIG. 2 to detect and drive the LED strings LEDST1 and LEDST2. It should be understood that, the present disclosure is not limited to the sequence of steps performed in the embodiment. In practice, the sequence of steps may be adjusted according to actual requirements. For example, S409 and S411 may be performed synchronously.

In step S401, the system 1000 of driving the LED string is enabled to obtain the updated operational parameters such as the brightness information BRT of the LED strings LEDST1 and LEDST2 of the display device.

In step S403, the system 1000 of driving the LED string may control the power supply device PSD and the input current source IS1 to provide the appropriate power to the LED strings LEDST1 and LEDST2 to set initial states of the LED strings LEDST1 and LEDST2, according to characteristics of the LED strings LEDST1 and LEDST2.

In step S405, the first terminal such as the drain terminal D1 of the transistor QP1 is connected to the negative terminal of the LED string LEDST1, and the first terminal such as the drain terminal D2 of the transistor QP2 is connected to the negative terminal of the LED string LEDST2. The first comparator COM1 and the second comparator COM2 of the system 1000 of driving the LED string obtain a detected voltage VGN1 of the control terminal such as the gate terminal G1 of the transistor QP1. The first comparator COM4 and the second comparator COM5 of the system 1000 of driving the LED string obtain a detected voltage VGN2 of the control terminal such as the gate terminal G2 of the transistor QP2.

In step S407, the first comparator COM1 determines whether or not the detected voltage VGN1 of the gate terminal G1 of the transistor QP1 is lower than the first reference voltage VR1 provided by the first reference voltage source. The first comparator COM4 determines whether or not the detected voltage VGN2 of the gate terminal G2 of the transistor QP2 is lower than the first reference voltage VR1.

If the detected voltage VGN1 of the gate terminal G1 of the transistor QP1 or the detected voltage VGN2 of the detected voltage VGN2 of the transistor QP2 is not lower than the first reference voltage VR1, step S409 is then performed. Conversely, if the detected voltage VGN1 of the gate terminal G1 of the transistor QP1 or the detected voltage VGN2 of the detected voltage VGN2 of the transistor QP2 is lower than the first reference voltage VR1, step S411 is then performed.

In step S409, if the detected voltage VGN1 of the gate terminal G1 of the transistor QP1 is equal to or higher than the first reference voltage VR1, the light controller LIGC controls the power supply device PSD to provide higher input power to the LED string LEDST1 such that the voltage of the LED string LEDST1 increases. On the other hand, if the detected voltage VGN2 of the gate terminal G2 of the transistor QP2 is equal to or higher than the first reference voltage VR1, the light controller LIGC controls the power supply device PSD to provide higher input power to the LED string LEDST2 to such that a voltage of the LED string LEDST2 increases.

In step S411, after the detected voltage VGN1 of the gate terminal G1 of the transistor QP1 is determined to be lower than the first reference voltage VR1, the second comparator COM2 of the system 1000 of driving the LED string determines whether or not the detected voltage VGN1 of the gate terminal G1 of the transistor QP1 is lower than the second reference voltage VR2 provided by the second reference voltage source. On the other hand, after the detected voltage VGN2 of the gate terminal G2 of the transistor QP2 is determined to be lower than the first reference voltage VR1, the second comparator COM5 of the system 1000 of driving the LED string determines whether or not the detected voltage VGN2 of the control terminal such as the gate terminal G2 of the transistor QP2 is lower than the second reference voltage VR2 provided by the second reference voltage source.

In step S413, if the second comparator COM2 determines that the detected voltage VGN1 of the gate terminal G1 of the transistor QP1 is not lower than the second reference voltage VR2, it is determined that a short circuit does not occur in the LEDs of the LED string LEDST1. On the other hand, if the second comparator COM5 determines that the detected voltage VGN2 of the gate terminal G2 of the transistor QP2 is not lower than the second reference voltage VR2, it is determined that the short circuit does not occur in the LEDs of the LED string LEDST2.

In step S415, if the second comparator COM2 determines that the detected voltage VGN1 of the gate terminal G1 of the transistor QP1 is lower than the second reference voltage VR2, the light controller LIGC controls the input current source IS1 to provide a larger input current to the LED string LEDST1 to step up an output current of the LED string LEDST1. On the other hand, if the second comparator COM5 determines that the detected voltage VGN2 of the gate terminal G2 of the transistor QP2 is lower than the second reference voltage VR2, the light controller LIGC controls the input current source IS2 to provide a larger input current to the LED string LEDST2 to step up an output current of the LED string LEDST2.

In step S411, after stepping up the output current of the LED string LEDST1 or LEDST2, it is determined whether or not the current flowing through the LED string LEDST1 or LEDST2 reaches a maximum current that is adjustable by the light controller LIGC. If it is determined that the current flowing through the LED string LEDST1 does not reach the maximum current, the processes for the LED string LEDST1 in step S411 is performed again. On the other hand, if it is determined that the current flowing through the LED string LEDST2 does not reach the maximum current, the processes for the LED string LEDST2 in step S411 is performed again.

Conversely, if it is determined that the current flowing through the LED string LEDST1 reaches the maximum current, it is determined that the short circuit occurs in the LED string LEDST1. On the other hand, if it is determined that the current flowing through the LED string LEDST2 reaches the maximum current, it is determined that the short circuit occurs in the LED string LEDST2.

Figure 4:
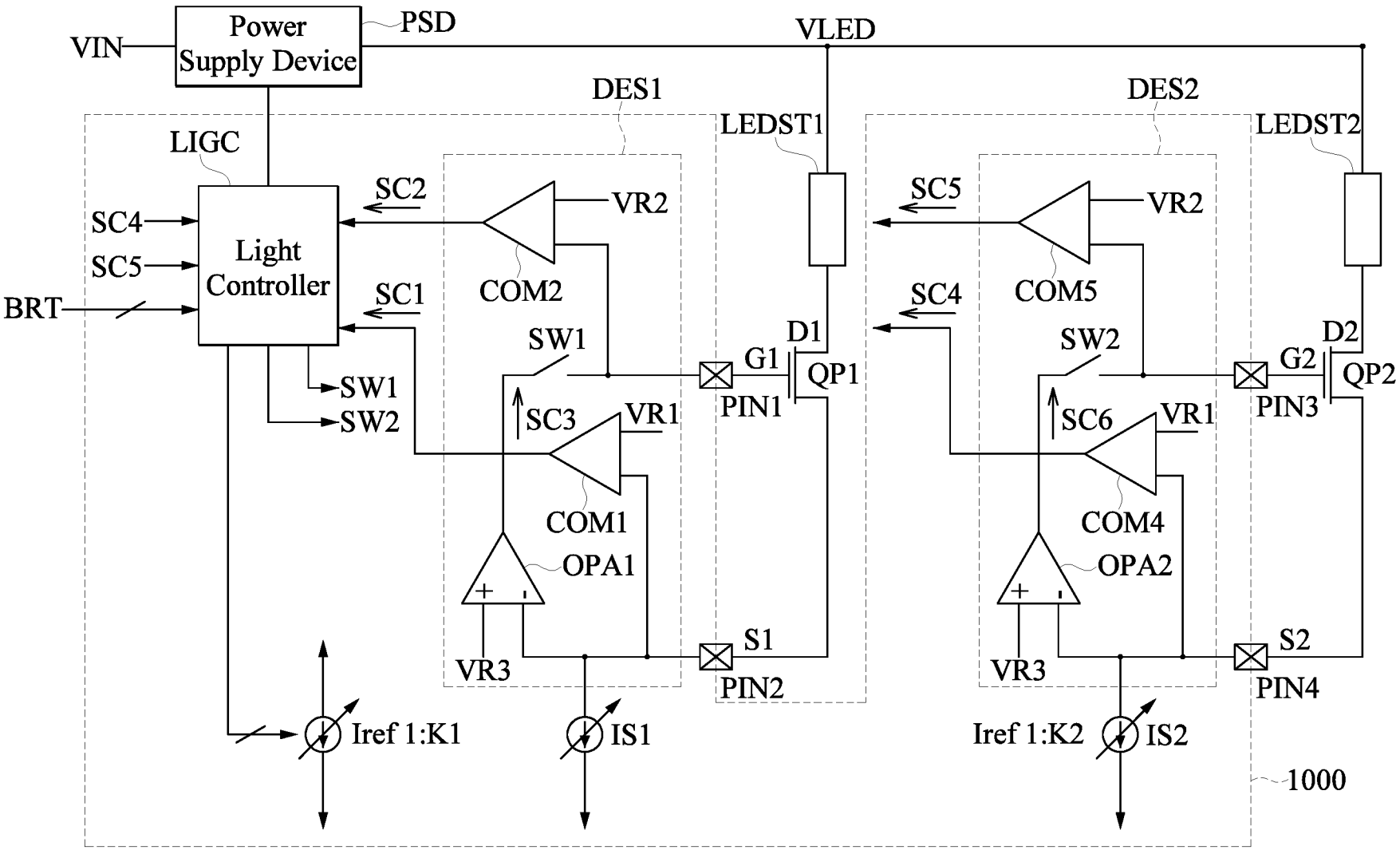
FIG. 4 is a circuit layout diagram of a system of driving a light-emitting diode string according to a third embodiment of the present disclosure.

With reference is made to FIG. 4, which is a circuit layout diagram of a system of driving a light-emitting diode string according to a third embodiment of the present disclosure. As shown in FIG. 4, in the third embodiment of the present disclosure, the system 1000 of driving the LED string is applicable to detect the operational parameter of the LED string LEDST1 of the display device and drive the LED string LEDST1 according to the operational parameter. The system 1000 of driving the LED string includes the first comparator COM1, the second comparator COM2, the first operational amplifier OPA1, the first switch SW1 and the light controller LIGC.

The circuit configuration and the operation of the second comparator COM2 of the third embodiment are substantially the same as that of the first comparator COM1 of the first embodiment. A difference between the third embodiment and the first embodiment is that, the fourth comparison input terminal of the second comparator COM2 of the first embodiment is connected to the gate terminal G1 of the transistor QP1, but the first comparator COM1 of the third embodiment is connected to the source terminal S1 of the transistor QP1.

In detail, the first comparator COM1 has the first comparison input terminal and the second comparison input terminal, which are respectively connected to the first reference voltage source and the second terminal such as the source terminal S1 of the transistor QP1. The first comparator COM1 is configured to compare a first detected voltage of the source terminal S1 of the transistor QP1 with the first reference voltage VR1 provided by the first reference voltage source to output the first comparing signal SC1 to the light controller LIGC.

The second comparator COM2 has a third comparison input terminal and a fourth comparison input terminal, which are respectively connected to the second reference voltage source and the control terminal such as the gate terminal G1 of the transistor QP1. The second comparator COM2 is configured to compare a second detected voltage of the gate terminal G1 of the transistor QP1 with the second reference voltage VR2 provided by the second reference voltage source to output the second comparing signal SC2 to the light controller LIGC.

The light controller LIGC controls the power supply device PSD to provide the input power to the LED string LEDST1 to control the LED string LEDST1 to emit the desired light, according to the first comparing signal SC1 from the first comparator COM1 and the second comparing signal SC2 from the second comparator COM2. At the same time, the light controller LIGC detects whether the short circuit or other abnormal conditions occur in the LED string LEDST1.

The detector circuit DES1 is expanded to obtain the detector circuit DES2. The detector circuit DES2 is used to detect the LED string LEDST2 and the LED string LEDST2 is accordingly driven according to a detection result. The configuration relationship and the operation of the circuit components included in the detector circuit DES2 are substantially the same as that of the above detector circuit DES1, and thus the description thereof will not be repeated.

Figure 5:
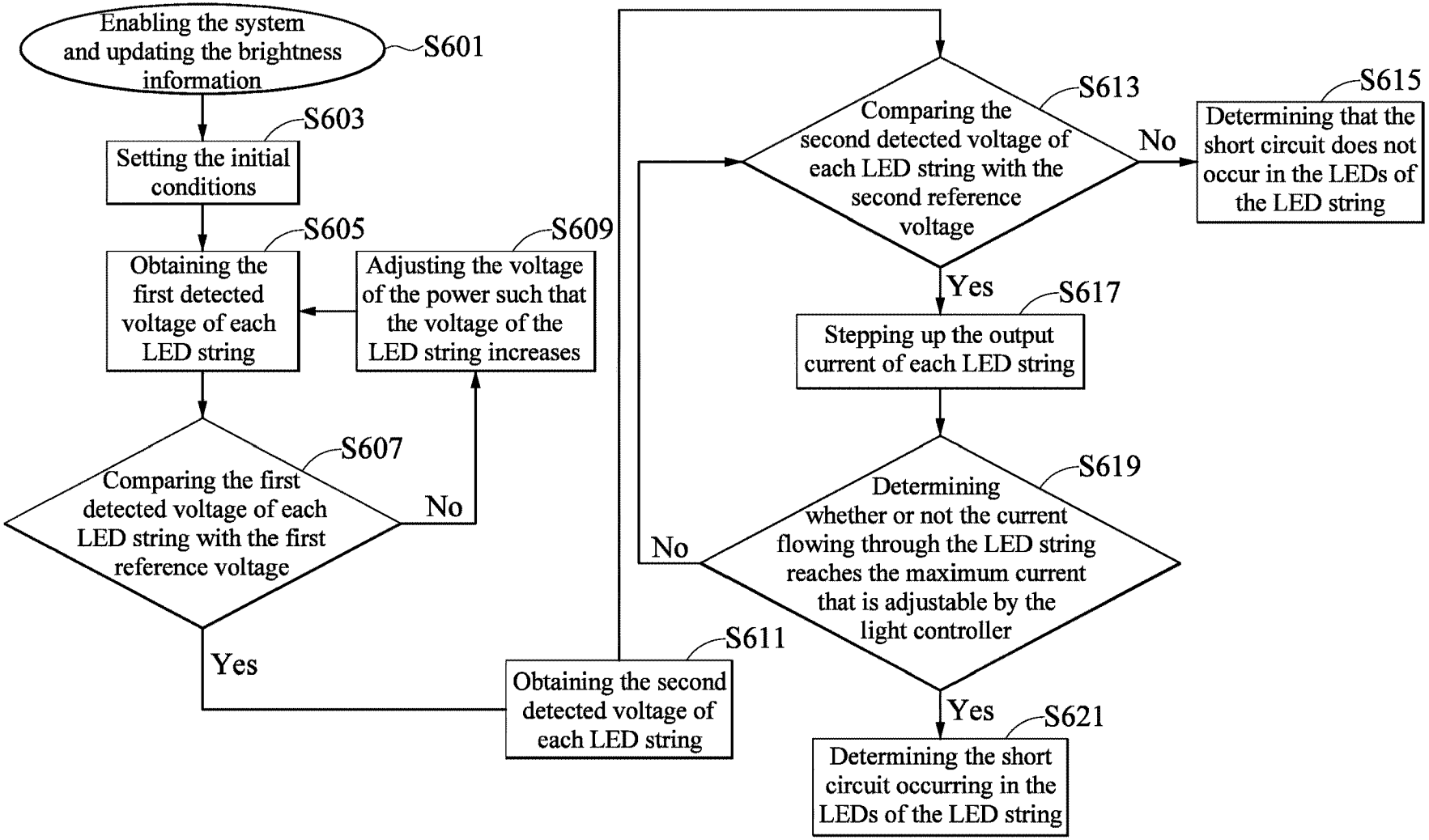
FIG. 5 is a flowchart diagram of a method of driving the light-emitting diode string according to the third embodiment of the present disclosure.

With reference is made to FIG. 5, which is a flowchart diagram of a method of driving the light-emitting diode string according to the third embodiment of the present disclosure. As shown in FIG. 5, in the third embodiment of the present disclosure, the method of driving the light-emitting diode string includes the following steps S601 to S621, which is applicable to the above system 1000 of driving the LED string. It should be understood that, the present disclosure is not limited to the sequence of steps performed in the embodiment. In practice, the sequence of steps may be adjusted according to actual requirements. For example, steps S607 and S613 may be performed synchronously.

In step S601, the system 1000 of driving the LED string is enabled to obtain the updated operational parameters such as the brightness information BRT of the LED strings LEDST1 and LEDST2 of the display device.

In step S603, the system 1000 of driving the LED string may control the power supply device PSD and the input current source IS1 to provide the appropriate power to the LED strings LEDST1 and LEDST2 to set the initial states of the LED strings LEDST1 and LEDST2, according to the operational parameters of the LED strings LEDST1 and LEDST2.

In step S605, the drain terminal D1 of the transistor QP1 is connected to the negative terminal of the LED string LEDST1, and the drain terminal D2 of the transistor QP2 is connected to the negative terminal of the LED string LEDST2. The first comparator COM1 of the system 1000 of driving the LED string obtains a first detected voltage VSN1 of the source terminal S1 of the transistor QP1. The first comparator COM4 of the system 1000 of driving the LED string obtains a second detected voltage VSN2 of the source terminal S2 of the transistor QP2.

In step S607, the first comparator COM1 determines whether or not the first detected voltage VSN1 of the source terminal S1 of the transistor QP1 is higher than or equal to the first reference voltage VR1. The first comparator COM4 determines whether or not the first detected voltage VSN2 of the source terminal S2 of the transistor QP2 is higher than or equal to the first reference voltage VR1. If the first detected voltage VSN1 of the source terminal S1 of the transistor QP1 or the first detected voltage VSN2 of the source terminal S2 of the transistor QP2 is lower than the first reference voltage VR1, step S609 is then performed. Conversely, if the first detected voltage VSN1 of the source terminal S1 of the transistor QP1 or the first detected voltage VSN2 of the source terminal S2 of the transistor QP2 is higher than or equal to the first reference voltage VR1, step S611 is then performed.

In step S609, if the first detected voltage VSN1 of the source terminal S1 of the transistor QP1 is lower than the first reference voltage VR1, the light controller LIGC controls the power supply device PSD to provide the input power to the LED string LEDST1 such that the voltage of the LED string LEDST1 increases. On the other hand, if the first detected voltage VSN2 of the source terminal S2 of the transistor QP2 is lower than the first reference voltage VR1, the light controller LIGC controls the power supply device PSD to provide the input power to the LED string LEDST2 such that the voltage of the LED string LEDST2 increases.

In step S611, the second comparator COM2 of the system 1000 of driving the LED string obtains the second detected voltage VGN1 of the gate terminal G1 of the transistor QP1. The second comparator COM5 of the system 1000 of driving the LED string obtains the second detected voltage VGN2 of the gate terminal G2 of the transistor QP2.

In step S613, the second comparator COM2 determines whether or not the second detected voltage VGN1 of the gate terminal G1 of the transistor QP1 is lower than the second reference voltage VR2. On the other hand, the second comparator COM5 determines whether or not the second detected voltage VGN2 of the gate terminal G2 of the transistor QP2 is lower than the second reference voltage VR2.

In step S615, if the second comparator COM2 determines that the second detected voltage VGN1 of the gate terminal G1 of the transistor QP1 is not lower than the second reference voltage VR2, it is determined that the short circuit does not occur in the LED string LEDST1. On the other hand, the second comparator COM5 determines that the second detected voltage VGN2 of the gate terminal G2 of the transistor QP2 is not lower than the second reference voltage VR2, it is determined that the short circuit does not occur in the LED string LEDST2.

In step S617, if the second comparator COM2 determines that the second detected voltage VGN1 of the gate terminal G1 of the transistor QP1 is lower than the second reference voltage VR2, the light controller LIGC controls the input current source IS1 to provide the input current to the LED string LEDST1 to step up the output current of the LED string LEDST1. On the other hand, if the second comparator determines that the second detected voltage VGN2 of the gate terminal G2 of the transistor QP2 is lower than the second reference voltage VR2, the light controller LIGC controls the input current source IS2 to provide the input current to the LED string LEDST2 to step up the output current of the LED string LEDST2.

In step S619, after stepping up the output current of the LED string LEDST1 or LEDST2, it is determined whether or not the current flowing through the LED string LEDST1 or LEDST2 reaches the maximum current that is adjustable by the light controller LIGC. If it is determined that the current flowing through the LED string LEDST1 does not reach the maximum current, the processes for the LED string LEDST1 in step S613 is performed again. On the other hand, if it is determined that the current flowing through the LED string LEDST2 does not reach the maximum current, the processes for the LED string LEDST2 in step S613 is performed again.

Conversely, if it is determined that the current flowing through the LED string LEDST1 reaches the maximum current, the second detected voltage VGN1 of the gate terminal G1 of the transistor QP1 cannot increase to be higher than or equal to the second reference voltage VR2, step S621 is performed. In step S621, it is determined that the short circuit occurs in the LEDs of the LED string LEDST1. On the other hand, if it is determined that the current flowing through the LED string LEDST2 reaches the maximum current, the second detected voltage VGN2 of the gate terminal G2 of the transistor QP2 cannot increase to be higher than or equal to the second reference voltage VR2, it is determined that the short circuit occurs in the LEDs of the LED string LEDST2.

In summary, the more external pins are required for connecting the conventional LED string driving system to the LED string such that the conventional LED string driving system can detect and drive the LED string. In contrast, the present disclosure provides the system of driving the LED string and the method thereof. Only one or two pins are required for connecting the system of driving the LED string of the present disclosure to the control terminal such as the gate or base terminal of the transistor and/or the second terminal such as the drain or collector terminal of the transistor. The voltages of the control terminal and/or the second terminal of the transistor are detected and controlled. The detected voltages are compared with two or more different reference voltages and accordingly the power supplied to each LED string is adjusted. The short circuit or other abnormal conditions occurring in the LED string can be determined while costs can be saved.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A method of driving a light-emitting diode (LED) string, which is applicable to detect an operational parameter of one or more LED strings of a display device and drive the one or more LED strings according to the operational parameter, wherein each LED string is connected to a transistor, the transistor has a first terminal, a second terminal and a control terminal, the first terminal of the transistor is connected to a negative terminal of the LED string, the second terminal of the transistor is connected to a reference potential, the control terminal of the transistor is connected to a system of driving the LED string, the method comprising the following steps:

(a) obtaining a detected voltage of the control terminal of the transistor by a first comparator;

(b) determining, by a first comparator, whether or not the detected voltage of the control terminal of the transistor is lower than a first reference voltage provided by a first reference voltage source, in response to determining that the detected voltage is not lower than the first reference voltage, controlling a power supply device to raise a voltage of the LED string by a light controller and then performing step (a), in response to determining that the detected voltage is lower than the first reference voltage, obtaining the detected voltage of the control terminal of the transistor by a second comparator;

(c) determining, by the second comparator, whether or not the detected voltage of the control terminal of the transistor is lower than a second reference voltage provided by a second reference voltage source, in response to determining that the detected voltage is not lower than the second reference voltage, determining that a short circuit does not occur in the LED string, in response to determining that the detected voltage is lower than the second reference voltage, controlling an input current source to provide an input current to the LED string such that an output current of the LED string increases by the light controller; and (d) determining, by the light controller, whether or not a current flowing through the LED string reaches a maximum current that is adjustable by the light controller, in response to determining that the current reaches the maximum current, determining a short circuit to occur in the LED string, in response to determining that the current does not reach the maximum current, returning to obtain the detected voltage of the control terminal of the transistor by the second comparator.

2. The method of claim 1, further comprising the following step:

comparing, by an operational amplifier, a voltage of the second terminal of the transistor with a third reference voltage provided by a third reference voltage source to output an operation amplified signal to the control terminal of the transistor.

3. The method of claim 2, further comprising the following step:

turning on a first switch to allow the operation amplified signal to be outputted to the control terminal of the transistor through the first switch, according to brightness information included in the operational parameter, by the light controller.

4. The method of claim 1, further comprising the following step:

adjusting a reference current source according to brightness information included in the operational parameter of the LED string, and adjusting the input current provided to the transistor from the input current source based on a preset ratio of the reference current source and the input current source, by the light controller.

5. A method of driving a light-emitting diode (LED) string, which is applicable to detect an operational parameter of one or more LED strings of a display device and drive the one or more LED strings according to the operational parameter, wherein each LED string is connected to a transistor, the transistor has a first terminal, a second terminal and a control terminal, the first terminal of the transistor is connected to a negative terminal of the LED string, the second terminal of the transistor is connected to a reference potential, the control terminal of the transistor is connected to a system of driving the LED string, the method comprising the following steps:

(e) obtaining a first detected voltage of the second terminal of the transistor by a first comparator;

(f) determining, by a first comparator, whether or not the first detected voltage of the second terminal of the transistor is higher than or equal to a first reference voltage, in response to determining the first detected voltage not being higher than or equal to the first reference voltage, controlling a power supply device to raise a voltage of the LED string by a light controller and then performing step (a), in response to determining the first detected voltage being higher than or equal to the first reference voltage, obtaining a second detected voltage of the control terminal of the transistor by a second comparator;

(g) determining, by the second comparator, whether or not the second detected voltage of the control terminal of the transistor is lower than a second reference voltage, in response to determining the second detected voltage not being lower than the second reference voltage, determining that a short circuit does not occur in the LED string, in response to determining the second detected voltage being lower than the second reference voltage, controlling an input current source to provide an input current to the LED string such that an output current of the LED string increases by the light controller; and (h) determining whether or not a current flowing through the LED string reaches a maximum current that is adjustable by the light controller, in response to determining that the current reaches the maximum current, determining the short circuit occurring in the LED string, in response to determining that the current does not reach the maximum current, returning to obtain the second detected voltage of the control terminal of the transistor by the second comparator.

6. The method of claim 5, further comprising the following step:

comparing a voltage of the second terminal of the transistor with a third reference voltage provided by a third reference voltage source to output an operation amplified signal to the control terminal of the transistor by an operational amplifier.

7. The method of claim 6, further comprising the following step:

turning on a first switch to allow the operation amplified signal to be outputted to the control terminal of the transistor through the first switch, according to brightness information included in the operational parameter, by the light controller.

8. The method of claim 5, further comprising the following step:

adjusting a reference current source according to brightness information included in the operational parameter of the LED string, and adjusting the input current provided to the transistor from the input current source based on a preset ratio of the reference current source and the input current source, by the light controller.

9. A system of driving a light-emitting diode (LED) string, which is applicable to detect an operational parameter of one or more LED strings of a display device and drive the one or more LED strings according to the operational parameter, wherein each LED string is connected to a transistor, the transistor has a first terminal, a second terminal and a control terminal, the first terminal of the transistor is connected to a negative terminal of the LED string, the second terminal of the transistor is connected to a reference potential, the control terminal of the transistor is connected to the system of driving the LED string, the system of driving the LED string comprising:

one or more first comparators each having a first comparison input terminal and a second comparison input terminal, which are respectively connected to a first reference voltage source and the control terminal of the transistor, the first comparator being configured to compare a detected voltage of the control terminal of the transistor with a first reference voltage provided by a first reference voltage source to output a first comparing signal;

one or more second comparators each having a third comparison input terminal and a fourth comparison input terminal, which are respectively connected to a second reference voltage source and the control terminal of the transistor, the second comparator being configured to compare the detected voltage of the control terminal of the transistor with a second reference voltage provided by the second reference voltage source to output a second comparing signal, wherein the second reference voltage is not equal to the first reference voltage; and a light controller connected to output terminals of the one or more first comparators and output terminals of the one or more second comparators;

wherein when the light controller determines that the detected voltage of the control terminal of the transistor is not lower than the first reference voltage according to the first comparing signal from the first comparator, the light controller controls a power supply device to raise a voltage of the LED string;

wherein when the light controller determines that the detected voltage of the control terminal of the transistor is not lower than the second reference voltage according to the second comparing signal from the second comparator, the light controller determines that a short circuit does not occur in the LED string;

wherein when the light controller determines that the detected voltage of the control terminal of the transistor is lower than the second reference voltage according to the second comparing signal from the second comparator, the light controller controls an input current source to provide an input current to the LED string such that an output current of the LED string increases; and wherein when the light controller determines that a current flowing through the LED string reaches a maximum current that is adjustable by the light controller, the light controller determines that a short circuit occurs in the LED string.

10. The system of claim 9, further comprising:

one or more operational amplifiers each having a first amplification input terminal and a second amplification input terminal, which are respectively connected to a third reference voltage source and the second terminal of the transistor, an output terminal of a first of the one or more operational amplifier being connected to the control terminal of the transistor, the first operational amplifier being configured to compare a voltage of the second terminal of the transistor with a third reference voltage provided by a third reference voltage source to output an operation amplified signal.

11. The system of claim 10, further comprising:

one or more switches each connected between the output terminal of the operational amplifier and the control terminal of the transistor, wherein when the light controller turns on a first of the one or more switch according to brightness information included in the operational parameter, the operation amplified signal is allowed to be outputted to the control terminal of the transistor through the first switch.

12. The system of claim 9, further comprising:

a reference current source and the input current source, which are connected to the light controller and the second terminal of the transistor, wherein the light controller is configured to adjust the reference current source according to brightness information included in the operational parameter of the LED string, the first comparing signal and the second comparing signal, and adjust the input current provided to the transistor from the input current source based on a preset ratio of the reference current source and the input current source.

13. The system of claim 9, wherein the light controller and the one or more LED strings are connected to the power supply device, and the light controller is configured to control the power supply device to provide an input power to the LED string to drive the LED string, according to brightness information included in the operational parameter of the LED string, the first comparing signal and the second comparing signal.

14. A system of driving a light-emitting diode (LED) string, which is applicable to detect an operational parameter of one or more LED strings of a display device and drive the one or more LED strings according to the operational parameter, wherein each LED string is connected to a transistor, the transistor has a first terminal, a second terminal and a control terminal, the first terminal of the transistor is connected to a negative terminal of the LED string, the second terminal of the transistor is connected to a reference potential, the control terminal of the transistor is connected to the system of driving the LED string, the system of driving the LED string comprising:

one or more first comparators each having a first comparison input terminal and a second comparison input terminal, which are respectively connected to a first reference voltage source and the second terminal of the transistor, the first comparator being configured to compare a first detected voltage of the second terminal of the transistor with a first reference voltage provided by a first reference voltage source to output a first comparing signal;

one or more second comparators each having a third comparison input terminal and a fourth comparison input terminal, which are respectively connected to a second reference voltage source and the control terminal of the transistor, the second comparator being configured to compare a second detected voltage of the control terminal of the transistor with a second reference voltage provided by the second reference voltage source to output a second comparing signal; and a light controller connected to output terminals of the one or more first comparators and output terminals of the one or more second comparators;

wherein when the light controller determines that the first detected voltage of the second terminal of the transistor is lower than the first reference voltage according to the first comparing signal from the first comparator, the light controller controls a power supply device to raise a voltage of the LED string;

wherein when the light controller determines that the second detected voltage of the control terminal of the transistor is not lower than the second reference voltage according to the second comparing signal from the second comparator, the light controller determines that a short circuit does not occur in the LED string;

wherein when the light controller determines that the second detected voltage of the control terminal of the transistor is lower than the second reference voltage according to the second comparing signal, the light controller controls an input current source to provide an input current to the LED string such that an output current of the LED string increases; and wherein when the light controller determines that a current flowing through the LED string reaches a maximum current that is adjustable by the light controller, the light controller determines that a short circuit occurs in the LED string.

15. The system of claim 14, further comprising:

one or more operational amplifiers each having a first amplification input terminal and a second amplification input terminal, which are respectively connected to a third reference voltage source and the second terminal of the transistor, an output terminal of a first of the one or more operational amplifier being connected to the control terminal of the transistor, the first operational amplifier being configured to compare a voltage of the second terminal of the transistor with a third reference voltage provided by a third reference voltage source to output an operation amplified signal.

16. The system of claim 15, further comprising:

one or more switches, each of which is connected between the output terminal of the first operational amplifier and the control terminal of the transistor, wherein when the light controller turns on a first switch of the one or more switches according to brightness information included in the operational parameter, the operation amplified signal is allowed to be outputted to the control terminal of the transistor through the first switch.

17. The system of claim 14, further comprising:

a reference current source and the input current source, which are connected to the light controller and the second terminal of the transistor, wherein the light controller is configured to adjust the reference current source according to brightness information included in the operational parameter of the LED string, the first comparing signal and the second comparing signal, and adjust the input current provided to the transistor from the input current source based on a preset ratio of the reference current source and the input current source.

18. The system of claim 14, wherein the light controller and the one or more LED strings are connected to the power supply device, and the light controller is configured to control the power supply device to provide an input power to the LED string to drive the LED string, according to brightness information included in the operational parameter of the LED string, the first comparing signal and the second comparing signal.

* * * * *